US006138796A

United States Patent [19]

Herschel

[11] Patent Number: 6,138,796

[45] Date of Patent: Oct. 31, 2000

[54] REACH TRUCK

[75] Inventor: Jan Herschel, Bad Oldesloe, Germany

[73] Assignee: Jungheinrich Aktiengesellschaft, Germany

[21] Appl. No.: 09/387,000

[22] Filed: Aug. 31, 1999

[51] Int. Cl.[7] ..... B66F 9/06

[52] U.S. Cl. ..... 187/232; 212/301; 280/755; 411/338

[58] Field of Search ..... 414/607; 280/762, 280/775; 187/232; 411/338, 339; 212/301

[56] References Cited

U.S. PATENT DOCUMENTS 2,785,817 3/1957 Pappathatos et al. ..... 414/607
3,095,182 6/1963 Platt ..... 414/607 X
4,478,532 10/1984 Paro ..... 411/338 X
4,787,793 11/1988 Harris ..... 411/339

FOREIGN PATENT DOCUMENTS 911937 10/1972 Canada ..... 187/232

*Primary Examiner*—Steven A. Bratlie
*Attorney, Agent, or Firm*—Vidas, Arrett & Steinkraus, P.A.

[57] ABSTRACT

A reach truck with two horizontal support legs supporting the reach truck by load wheels and the end of the legs. Simple means are provided to manufacture such trucks with varying spaces between the support legs.

5 Claims, 4 Drawing Sheets

REACH TRUCK

BACKGROUND OF THE INVENTION

The invention refers to a reach truck. Particularly to such ground conveying vehicles that include a lifting structure or mast and/or a load support means (fork) which is adapted to be elevated at a support structure and which can be also horizontally displaced. This allows loading or unloading of a palette in a rack by the support means. The loading of high racks with reach trucks is generally known. Usually, the reach trucks have telescopically extendable masts, with the load support means being mounted on the inner mast portion which is guided along the each outer mast portion. Usually, three mast portions are employed with the most outer mast portion being stationary, i. e. fixedly attached to the driving portion of the reach truck.

It is further known to provide such reach trucks with wheeled legs. The legs or arms are fixedly attached to the drive portion or the support structure or the mast and extend parallel to each other away from the driving portion and parallel to the fork of the load support means. At the end of each leg there is located at least one load wheel. The space between the legs is larger than the size of a palette. Therefore, the reach truck may drive laterally of the palette with its legs in order to allow the engagement of the fork with the palette. Correspondingly; the legs allow a depositing of the palette on the ground between the legs.

For space reasons the space between the legs is selected such that the space is not larger than necessary for the palettes to be handled. However, it is known that a plurality of different palette sizes exists. The present invention may be adapted to provide for different size pallets to be handled.

BRIEF SUMMARY OF THE INVENTION

It is an objective of the invention to provide a reach truck which can be easily adapted to different sizes of the palettes.

In the reach truck according to the invention the wheeled legs are attached laterally to the support structure, in particular to the outer mast portion fixedly attached to the driving portion. The wheeled legs have to withstand high forces. For this reason it is impossible to make them displaceable for the purpose of an adaptation to different widths of the palette as is already known. Rather, plate portions are attached laterally to the mast portion, with the plate portion cooperating with plate portions on the wheeled legs. The coacting plate portions have cooperating surfaces which are pressed against each other by suitable clamping means. Such clamping means for example can be defined by screws. Therefore, the invention provides recesses and projections at the cooperating surfaces of the plate portions which fittingly interengage. These projections and recesses substantially receive the forces on the wheeled legs and transfer then into the support structure. The clamping means function to press the plate portions against each other and to maintain the interengagement of the projections and the recesses. A connection portion is provided between the plate portions of the wheeled legs and the mast. This connection portion can be provided with a variable width or length in order to vary the space between parallel wheeled legs.

The construction of the invention allows a modular manufacture. The plate portions can always have uniform sizes and thicknesses. The same goes with the wheeled legs. Only the dimension of the connection portion may vary. The expense for the manufacture of reach trucks having different spaces of the wheeled legs, thus, is relatively small. This expense hardly exceeds that for the manufacture of reach trucks with a standard space between the wheeled legs.

For the interconnection of the plate portions different constructions are conceivable. In a preferred embodiment of the invention the first plate portion has threaded bores and the second plate portion has through-going bores which can be aligned with the threaded bores. Both the threaded bore and the through-going bore having adjacent end portions of larger diameter. The larger bore portions accommodate a longitudinally slotted clamping sleeve under radial tension. Thus, the clamping sleeve provides for the fitting interengagement between the plate portions. A threaded pin extends through the bores and the clamping sleeve and is threaded into the threaded bore in order to clampingly press the plate portions against each other. To this purpose the threaded pin may have a flange at the head portion which flange engages the second plate portion. Preferably, a plurality of such interconnection means is provided in order to fittingly connect the plate portions with each other. For example, a first and a second row of such connection means can be provided which rows extending horizontally and parallel to each other.

In spite of the described construction the plate portions may have different projections, e. g. plugs or the like, and recesses fittingly accommodating the projections in order to establish a fitting connection between the parts. By screw means the plate portions can be clamped together.

The wheeled legs may have a horizontally extending portion which bears a load wheel at the free end thereof and an inclined portion which ascends towards the driving portion. The plate portions can be mounted on the inclined portion. In case a larger space between the wheeled legs is necessary a connection profile can be positioned between the inclined portion and the second plate portion in order to provide for the desired space between the legs. The attachment of the plate portions to the support structure and the wheeled legs, respectively, is preferably by welding. The attachment of the connection profile to the second plate portion and the inclined leg portion is also preferably made by welding. From this it can be seen that for the adjustment of the desired space between the legs only connection profile of different length are to be stored or supplied. All construction parts can be uniform or modular, respectively.

BRIEF DESCRIPTION OF THE SEVERAL VIEWS OF THE DRAWINGS

A preferred embodiment example of the invention is substantially described herein and shown in the accompanying drawings as follows.

DETAILED DESCRIPTION OF THE INVENTION

Figure 1:
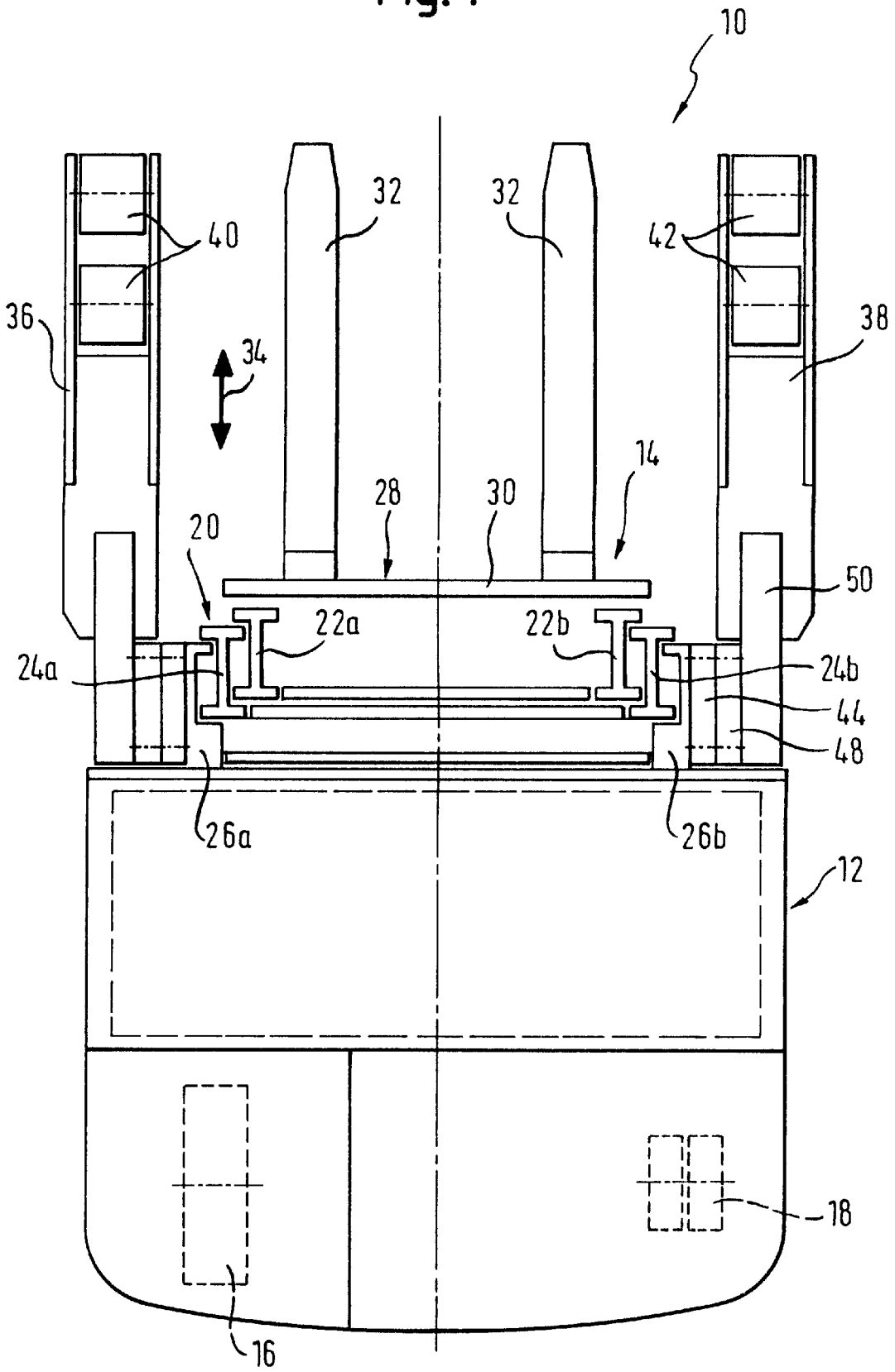
FIG. 1 shows diagrammatically a plane view of a reach truck according to the invention.

FIG. 1 shows a plan view on a reach truck 10 which has a driving portion 12 and a load portion 14. The driving portion 12 has an asymmetrically arranged driving wheel 16 and a support wheel arrangement 18 parallel to the driving wheel.

The load portion 14 has a telescopic support structure 20 consisting of an inner mast with the mast profiles 22*a*, 22*b*, a middle mast with the mast profiles 24*a*, 24*b* and an outer mast with the mast profiles 26*a*, 26*b*. The mast profiles 26*a*, 26*b* are fixedly attached to the driving portion 12 which is not shown in detail. The mast profiles 24*a*, 24*b* are telescopically guided by the outer mast profiles 26*a*, 26*b*. The mast profiles 22*a*, 22*b* are telescopically guided by the middle mast profiles 24*a*, 24*b*. The actuation of the inner and the middle mast is not shown. This is carried out by means of lifting cylinders (not shown) and chains (not shown). This is a known construction with such conveying vehicles.

A load support means 28 can be lifted along the inner mast with the profiles 22*a*, 22*b* which includes a slide 30 and a fork 32. The actuation of the support means 28 by corresponding lifting cylinders is also known and not to be described in detail. By means of a mechanism which is also not shown the complete load portion 14 can be limitedly horizontally displaced as shown by double arrow 34. This is also prior art in connection with reach trucks.

Two wheeled legs 36, 38 are attached to the outer side of the support structure 20. The legs have two load wheels 40, 42 at the ends thereof. In the following the detail 2 of FIG. 1 is explained in more detail along FIG. 2.

A first plate portion 44 is welded to the outer side of the outer mast profile 26*b* as shown at 46. A second plate portion 48 is flush mounted against plate portion 44. The plate portion 48 has a connection portion 50 which for example may be welded thereto and which may be part of a wheeled arm as will be explained in more detail along FIG. 3.

The plate portion 44 has a threaded bore 52, and the plate portion 48 has a through-going bore 54, with the bores 52, 54 being aligned. Both bores at the adjacent ends have a bore portion 56, 58 with a larger diameter. A longitudinally slotted clamping sleeve 60 is accommodated by the bore portions 56, 58 under radial pressure. A threaded bolt 62 is extended through bore 54 and threaded into the threaded bore 52. A portion of the threaded bolt 52 extends beyond the plate portion 58. The bolt 62 has a head 64 with a flange engaging the outer side of plate portion 48. Thus, the plate portions 44, 48 may be clamped together. The connection structure between the plate portions 44, 48 is described only as a possible example. It is understood that also differently structured connection constructions can be used.

Figure 2:
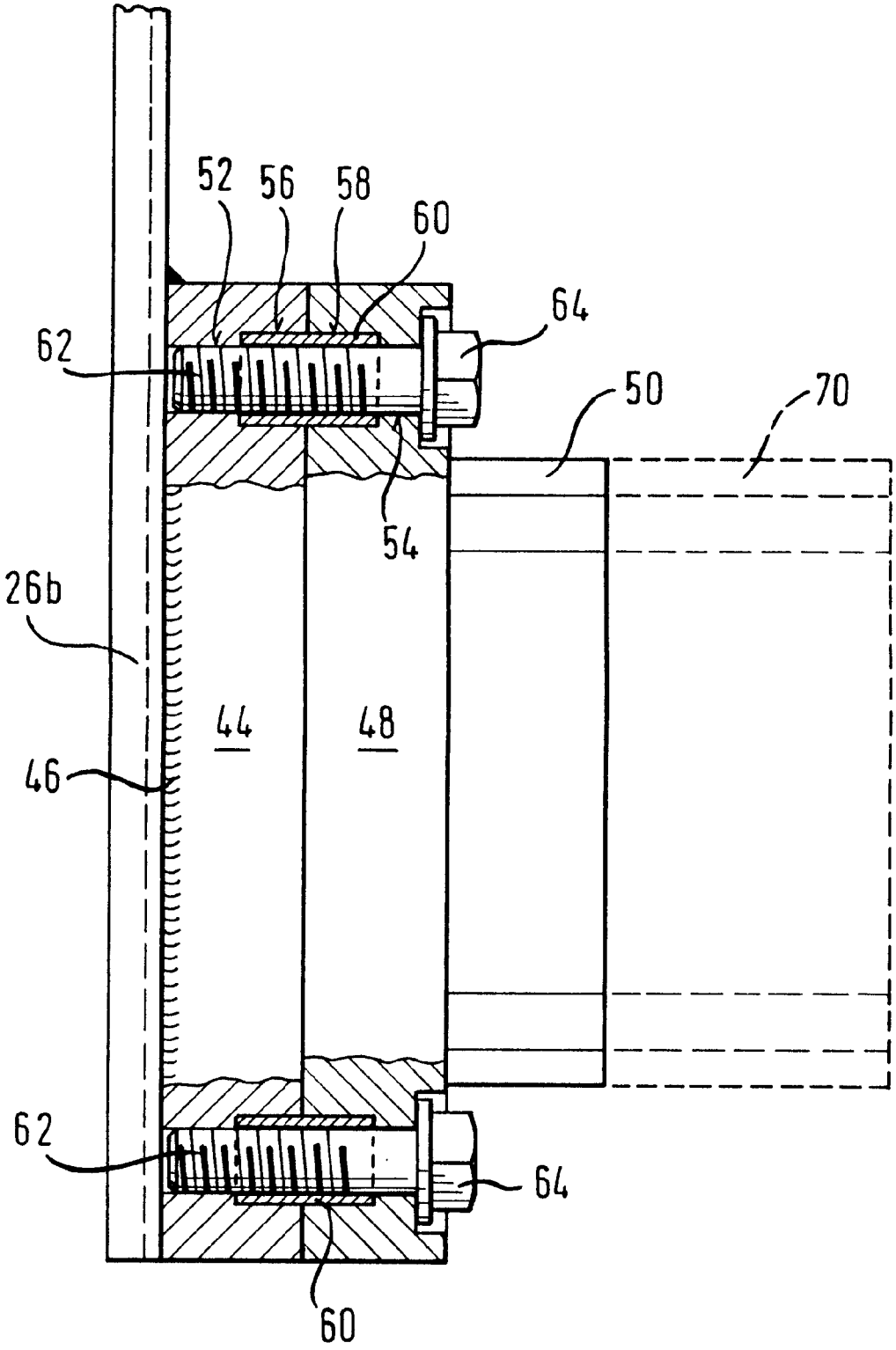
FIG. 2 shows at a larger scale a detail of FIG. 1, partially in cross section, however in a view turned about 90°, i. e. from the back of a wheeled leg.
Figure 3:
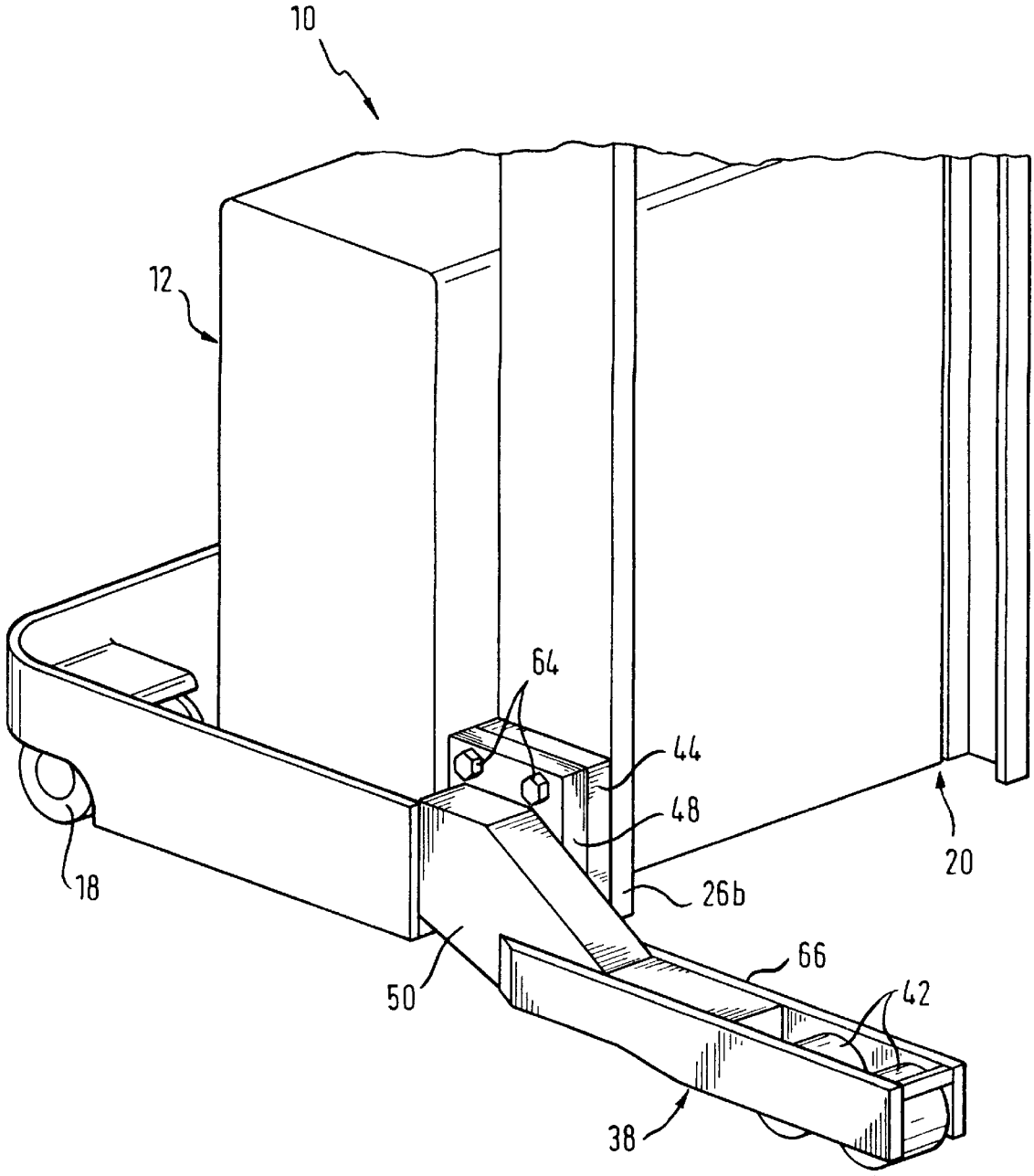
FIG. 3 shows a perspective view of a portion of the reach truck of FIG. 1.

It can be seen in FIG. 3 that the wheel leg 38 has a horizontal portion 66 and a rising portion 50 which according to FIGS. 1 and 2 defines a connection portion for the plate portion 48. The thickness of plate portions 44, 48 defines thus the space between the wheeled legs 38, 38 (in FIG. 3 only wheeled leg 36 of FIG. 1 is shown. Furthermore, individual parts of the support structure are also not shown in FIG. 3).

Figure 4:
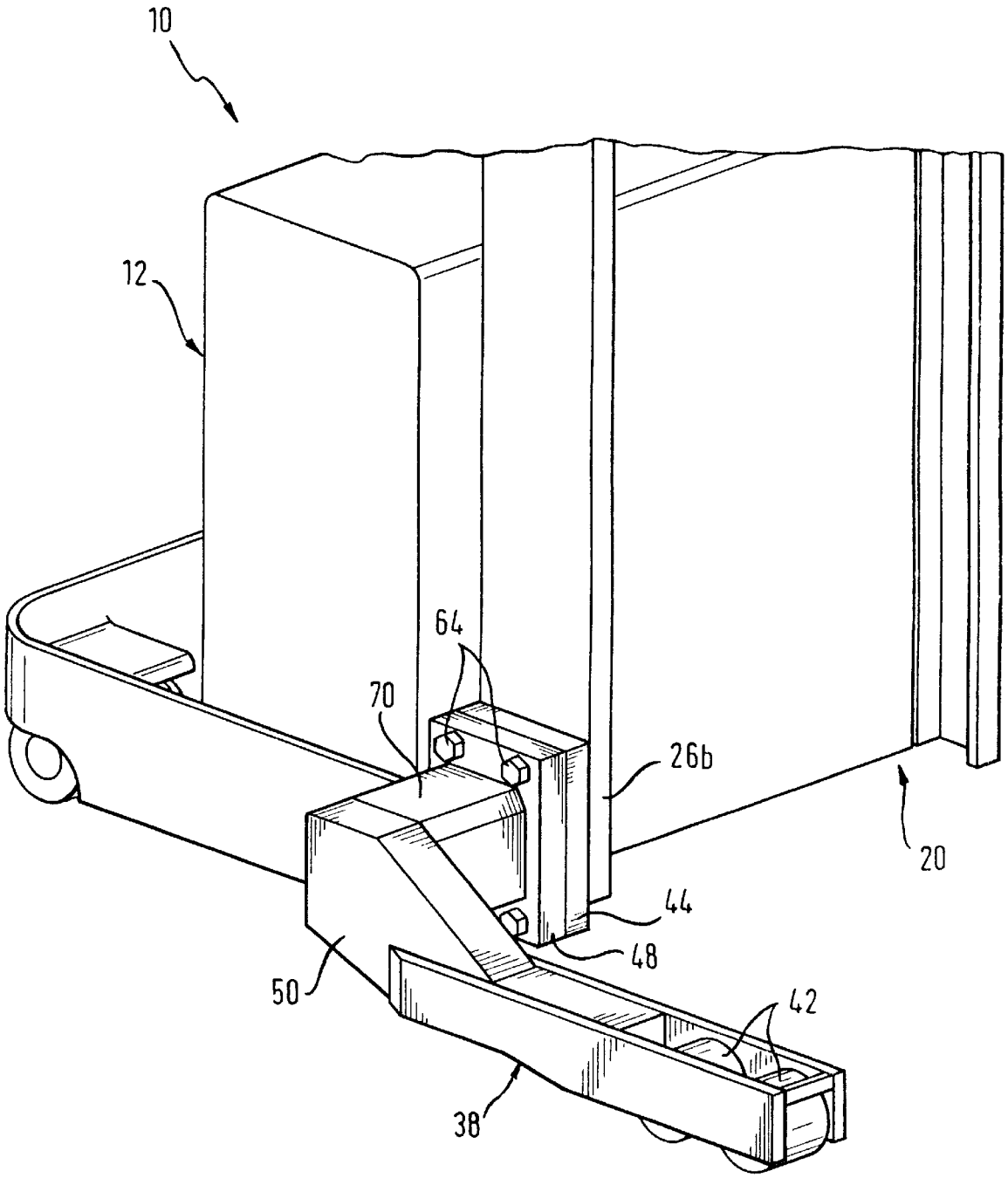
FIG. 4 shows a similar perspective view as FIG. 3, however with a different space between the wheeled legs.

From the illustration in FIG. 4 it can be seen that the construction of the reach truck is substantially equal to that of FIG. 3. Therefore, the same parts are provided with the same reference numbers. It can be further seen that the wheeled leg 38 has the same structure as the wheeled leg of FIG. 3. The only difference is that a horizontal box-like connection profile 70 is provided which interconnects the second plate portion 48 and the inclined leg portion 50. The attachment of the connection profile 70 is preferably by welding. By means of the connection profile the space between the wheeled legs is enlarged by the double of the length of the connection profile 70.

It should be considered in FIG. 2 that the box-like connection portion 70 which is indicated only by dotted lines in reality is placed between plate portion 48 and connection portion 50 of the respective leg. This is not shown in FIG. 2. FIG. 2 is to show in one illustration both embodiments, i.e. one with and one without a connection profile.

When manufacturing the shown reach truck the basis construction of the support structure and the wheeled legs can be the same. It is merely necessary either to take only a plate portion 48 or connection profiles 70 of different stepped length in order to achieve stepped spaces between the wheeled legs 36, 38.

When manufacturing the wheeled legs first the plate portions 44 are welded to the support structure, with the plate portions already provided with threaded bores 52. The clamping sleeves 50 are introduced into the enlarged bore portion of the threaded bores. The enlarged bore portions 56, 58 have no thread portion. Subsequently, plate portion 48 is installed. In accordance with the desired space between the wheeled legs a plate portion 48 is either directly attached to inclined portion 50 of wheeled leg 38 or through a connection profile such as connection profile 70. The unit of wheeled leg and plate portion 48 is then plugged on the exposing clamping sleeves 60. Thereafter, the threaded bolt is placed through the clamping sleeve 60 and threaded into the threaded bore 52. By means of the threaded bolt 62 and the head 64 thereof the plate portions 44, 48 are firmly clamped against each other.

In the manufacture of the reach truck according to the invention it is only necessary to store connection profiles 70 of different length in order to provide for a great number of different spaces between the wheeled legs.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. A reach truck comprising a driving portion, a vertically extending lifting structure having lateral outer sides attached to said driving portion;

a load support means including fork means for lifting and lowering a load placed on said fork means, said load means being adapted to be guided along said lifting structure, said load support means and said lifting structure, respectively, being horizontally displaceable;

two support legs attached to the lateral outer sides of said lifting structure and extending horizontally parallel away from said driving portion, each of said support legs bearing a load wheel at the end thereof;

a first plate portion fixedly secured to the lateral outer sides of said lifting structure;

a second plate portion fixedly secured to said support legs, said first and said second plate portion having mutually engaging surfaces, said surfaces are adapted to fittingly interengage;

clamping means effecting on said plate portions in order to clamp said surfaces against each other; and a connection portion of variable length between said second plate portion and said respective support leg.

2. The reach truck of claim 1, wherein said first plate portion has threaded bores, the second plate portion has through-going bores which are adapted to be aligned with said threaded bores, end portions of said threaded bores and said through-going bores adjacent to each other having a bore portion of larger diameter which bore portion being adapted to accommodate a longitudinally slotted clamping sleeve under radial pressure, a threaded bolt extending through said bores and said clamping sleeve and being threaded into the threaded bore, the threaded bolt having a head portion engaging the outer side of the second plate portion in order to press the plate portions against each other.

3. The reach truck of claim 2, wherein two parallel horizontal spaced rows of bores and bolts are provided.

4. The reach truck of claim 1, wherein the wheeled leg (50) have an approximately horizontal portion (66) and an inclined portion (50) at the end adjacent the driving portion (12), the inclined plate like portion defining a connection which ascends towards the driving portion and the lifting structure, and the second plate portion is attached to the side of the inclined portion adjacent the lifting structure.

5. The reach truck of claim 4, wherein a horizontal connection profile is located between the inclined portion and the second plate portion.

* * * * *